United States Patent [19]

Fulgoni

[11] Patent Number: 5,007,443

[45] Date of Patent: Apr. 16, 1991

[54] PROTECTIVE DEVICE FOR PROTECTING EARLIER TREATED HAIR

[76] Inventor: Jean C. Fulgoni, 2, rue Diderot, 92170, Vanves, France

[21] Appl. No.: 187,245

[22] Filed: Apr. 28, 1988

[30] Foreign Application Priority Data

May 12, 1987 [FR] France ..... 87 06644

[51] Int. Cl.[5] ..... A45D 19/18

[52] U.S. Cl. ..... 132/270; 132/222

[58] Field of Search ..... 132/207, 222, 221, 270

[56] References Cited

U.S. PATENT DOCUMENTS

| | | | |
|---|---|---|---|
| 1,994,009 | 3/1935 | Fulton | 132/222 |
| 2,065,874 | 12/1936 | Salvio | 132/221 |
| 2,139,311 | 12/1938 | Moore | 132/222 |
| 3,143,117 | 8/1964 | Ruud | 132/270 |
| 3,692,032 | 9/1972 | Regas | 132/270 |
| 4,144,897 | 3/1979 | Mosz | 132/270 |
| 4,196,741 | 4/1980 | Minghenelli | 132/270 |
| 4,258,733 | 3/1981 | Fulgoni | 132/270 |
| 4,465,084 | 8/1984 | Fulgoni | 132/245 |
| 4,552,159 | 11/1985 | Fabbri et al. | 132/207 |

FOREIGN PATENT DOCUMENTS

| | | | |
|---|---|---|---|
| 0126618 | 11/1984 | European Pat. Off. | 132/222 |

*Primary Examiner*—Gene Mancene
*Assistant Examiner*—Adriene B. Lepiane
*Attorney, Agent, or Firm*—Larson and Taylor

[57] ABSTRACT

A protective device is provided for carrying out a permanent wave with a permanent wave product on a hair solely in the vicinity of the root thereof and for protecting from the action of the permanent wave product the part of the hair which is not situated close to the root. This device includes a flexible and liquid-tight sheet (1), a reinforcement zone (2) extending along a first edge of the sheet and an arresting element (3) comprising an absorbent strip or pad along the opposite edge of the sheet. If further comprises a fixing structure, for example a strip carrying hook shaped elements situated on or forming the reinforcement zone (2) for temporarily and removably fixing the protective device to the hair prior to winding the device and the hair on a roller.

4 Claims, 1 Drawing Sheet

FIG. 1.
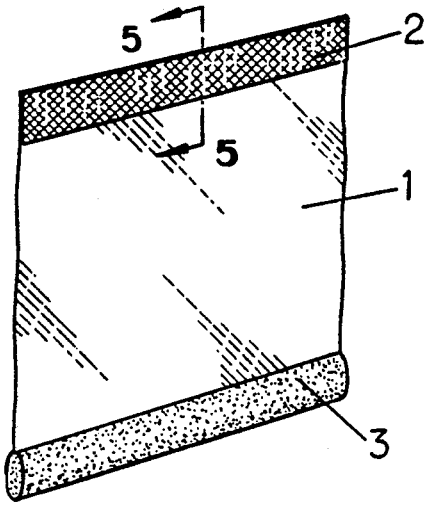
FIG. 2.
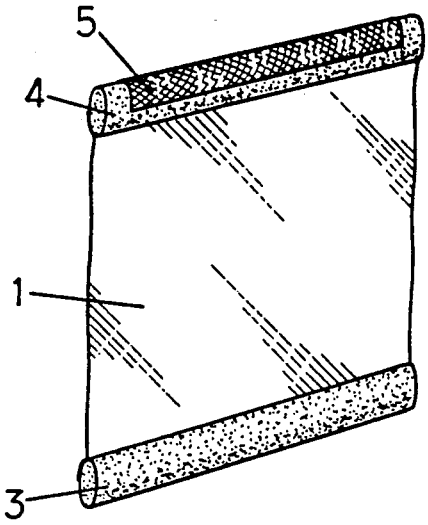
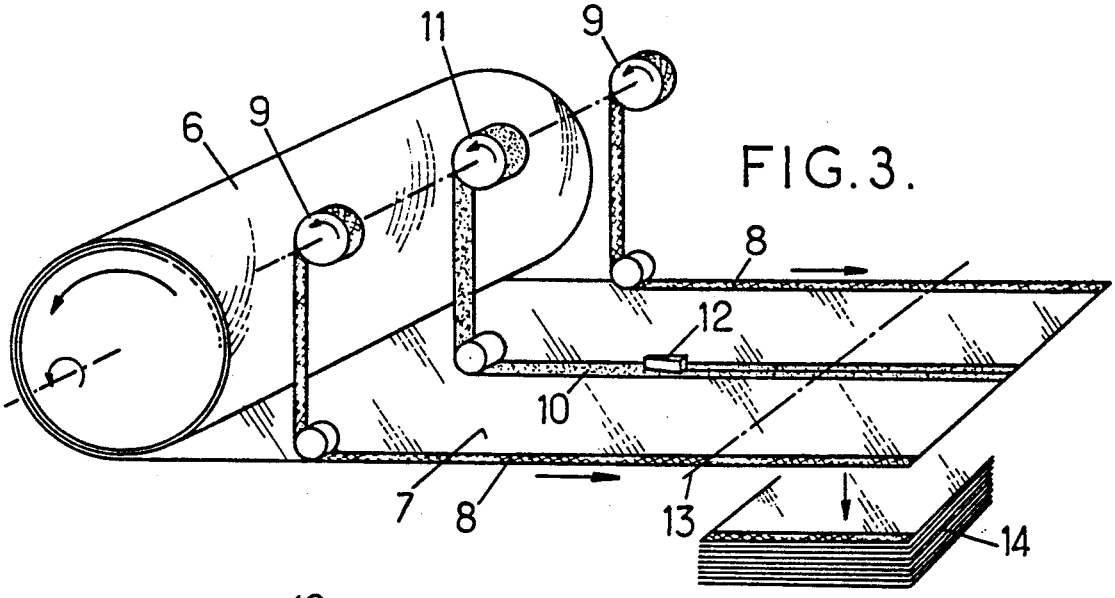
FIG. 3.
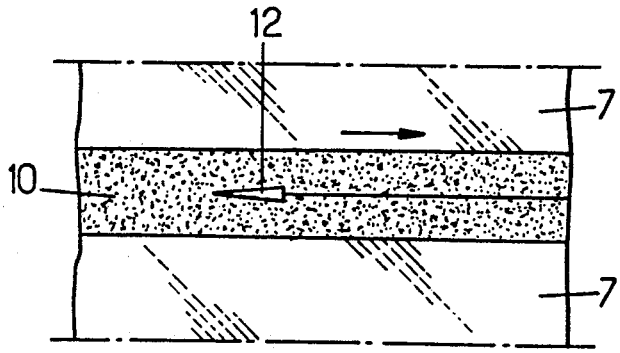
FIG. 4.
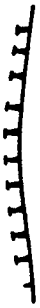
FIG. 5

PROTECTIVE DEVICE FOR PROTECTING EARLIER TREATED HAIR

BACKGROUND OF THE INVENTION

1. Field of the Invention

A protective device for protecting, during a permanent wave, the portion of the hair treated earlier, and a method for manufacturing such protective devices.

The present invention relates to improvements to protective devices for carrying out a permanent wave with a permanent wave product on a hair solely in the vicinity of the root thereof and to protect from the action of the permanent wave product the part of the hair which is not situated close to the root and which has already been treated during earlier permanent waves, said device including a flexible and liquid tight sheet, a reinforcement zone exending along a first edge of said sheet and arresting means comprising a strip or pad of an absorbent material fixed to, and extending along, the edge of the sheet opposite said first edge, the length of the sheet being sufficient so that the arresting means and the reinforcement zone can be situated substantially opposite each other when the protective device is in the functional position about the hair to be protected.

A protective device of the above kind is known from U.S. Pat. No. 4,258,733. Such a protective device is completely satisfactory for protecting the part of the hair already treated, in accordance with the desired aim: however, its positioning on the hair is delicate to carry out because the protective device tends to slide and it requires great dexterity on the part of the user.

SUMMARY OF THE INVENTION

The purpose of the invention is essentially to propose a protective device which better answers different requirements of practice and which, in particular, is adapted so as not to slide on the hair during positioning on the roller and which, in addition, is designed so as to be able to be manufactured in large quantities simply and at lower cost.

To these ends, the protective device of the invention is characterized in that it further comprises fixing means for temporarily and removably fixing the reinforcement zone of the protective device to the hair prior to winding said device and the hair on a roller.

With this arrangement, the protective device may be accurately positioned on the hair and its adherence thereto facilitates winding thereof with the hair on the support roller. The user's work is thus appreciably simplifed, and, because the protective device no longer slides on the hair during winding, the efficiency of protecting the part of the hair already treated earlier against new application of this product is considerably increased.

Of course, different embodiments are possible, which lead to the desired result.

The fixing means are provided on said reinforcement zone or form said reinforcement zone.

The fixing means may also be provided both on the reinforcement zone, the means then possibly forming said reinforcement zone, and on the absorbent material strip or pad.

In both cases, the reinforcement zone may comprise a foam strip or pad and if required this foam may also be absorbent.

All or part of the fixing means are formed by a strip carrying hook shaped elements (Velcro).

Furthermore, the protective device of the invention is particularly advantageous beause it lends itself very well to continuous large scale manufacture, using the method comprising the following steps:

- a roll of flexible and liquid-tight film is unwound continuously;
- to said film during unwinding are fixed at least two lateral strips (reinforcement strips or absorbent strips) and, therebetween and substantially at equal distances therefrom, a central strip (respectively absorbent strip or reinforcement strip);
- said film is cut longitudinally in the middle through the middle of the central strip;
- then the two half films are cut transversally into sections forming protective devices.

BRIEF DESCRIPTION OF THE DRAWINGS

The invention will be better understood from reading the detailed description which follows of some of its preferred embodiments given solely by way of non limitative examples. In this description, reference is made to the accompanying drawings in which:

FIGS. 1 and 2 are schematical perspective views of two possible embodiments, respectively;

FIG. 3 is a schematical perspective view of a large scale manufacturing process, illustrating the practice of the method of the invention; and FIG. 4 is a schematical view on a large scale illustrating a detail of the process of FIG. 3.

FIG. 5 is an enlarged cross-sectional view taken along 5—5 of FIG. 1.

DETAILED DESCRIPTION OF THE PREFERRED EMBODIMENTS

As shown in FIGS. 1 and 2, the protective device of the invention comprises, in a way known per se, a sheet 1 made from a thin, flexible and liquid-tight plastic material, one edge of which is provided with a reinforcement zone 2 and the other edge of which, opposite the preceding one, is provided with a strip or pad 3 made from an absorbent material (for example a synthetic foam) adapted for absorbing the permanent wave product and for preventing it rising by capillarity along the hair. Furthermore, another strip or pad 4, made from a material which is absorbent or not, may be provided on or in place of the reinforcement zone 2, as shown in FIG. 2. The method of using such a protective device has already been described in U.S. Pat. No. 4,258,733, and will therefore not be explained again here.

In accordance with the invention, the protective device is provided with means for fixing on the hair so as to facilitate positioning on the hair and on the roller and prevent it from sliding inconveniently with respect to the hair. For this purpose, the reinforcement zone 2 (FIG. 1) for this purpose, the reinforcement zone 2, as shown in FIG. 1, may be provided or formed wholly or partially of a strip having fine engagement elements, as shown in FIG. 5, generally commercialized under the name VELCRO.

It is also possible for the strip or pad 4 (FIG. 2) to have adherent properties, for example by providing an adhesive substance layer 5 over the whole or a part thereof.

Of course any arrangement and/or any combination of arrangements for temporarily fixing the protective device to the hair so that winding of the device and of the hair on the rollers is facilitated and is not accompanied by sliding of the device with respect to the hair may be envisaged.

Similarly, the improvements made within the scope of the invention apply not only to the basic type of protective device described in the preamble and shown in FIGS. 1 and 2, but also to all the variants which may be formed from this basic configuration, such for example as those described in U.S. Pat. No. 4,465,084.

Besides the above advantages, the protective device of the invention also has other advantages which reside in its simplicity and its lower manufacturing cost resulting from the possibility of producing these protective devices continuously on a large scale.

To this end, as shown in FIGS. 3 and 4, a roll 6 of a thin, flexible and liquid-tight film 7 may be used, which is continuously unwound. In the example shown, the width of the film is substantially twice the length of sheet 1 of the protective device as shown in FIGS. 1 and 2.

Along both edges of film 7 are fixed, continuously for example by bonding, respectively two lateral strips 8, (provided by the continuous unwinding of two rolls 9 respectively) forming either said absorbent pad or said reinforcement zone. Simultaneously, a central strip 10 (provided by the continuous unwinding of a third roll 11) is continuously fixed to film 7 between the two lateral strips 8, substantially half way therebetween, this central strip forming respectively either the reinforcement zone, or the absorbent pad.

Film 7 thus provided with its three strips, lateral and central, then passes over a longitudinal cutter 12, disposed so as to cut the film continuously through the middle of the central strip 10 as shown in FIG. 4.

Finally, a transverse cutter (not shown), movable vertically, cuts the two half films transversally along line 13 and provides two protective devices disposed head to tail which are then recovered at 14.

Of course it is possible to increase the width of film 7 and to consequently increase the number of longitudinal cutters, so as to obtain a higher number of protective devices at each transverse cut made along line 13.

As is evident and as it follows moreover already from what has been discussed above, the invention is in no wise limited to those of its embodiments and modes of application which have been more explicitly considered, it covers on the contrary all variants thereof.

I claim:

1. A protective device for carrying out a permanent wave with a permanent wave product on a hair solely in the vicinity of the root thereof and to protect from the action of the permanent wave product the part of the hair which is not situated close to the root, said device including a flexible and liquid-tight sheet (1), a reinforcement zone (2) extending along a first edge of said sheet and an arresting means (3) comprising a strip or pad of an absorbent material fixed to and extending along the edge of the sheet opposite said first edge, the length of the sheet being sufficient so that the arresting means and the reinforcement zone are situated substantially opposite each other when the protective device is in the functional position about the hair to be protected; characterized in that the device further comprises fixing means for temporarily and removably fixing the protective device to the hair prior to winding said device and the hair on a roller, said fixing means being provided on said reinforcement zone or forming said reinforcement zone, and wherein all or part of said fixing means are formed by a strip carrying hook shaped elements.

2. A protective device according to claim 1, characterized in that the fixing means are provided both on the reinforcement zone, forming at least a part of said reinforcement zone, and on the absorbent material strip or pad.

3. A protective device according to claim 1, characterized in that the reinforcement zone comprises a foam strip or pad (4).

4. A protective device according to claim 3, characterized in that the foam is absorbent.

* * * * *

UNITED STATES PATENT AND TRADEMARK OFFICE

CERTIFICATE OF CORRECTION

PATENT NO. : 5,007,443

DATED : April 16, 1991

INVENTOR(S) : FULGONI, Jean-Claude

It is certified that error appears in the above—identified patent and that said Letters Patent is hereby corrected as shown below:

Column 2, lines 56 and 57, please delete "this purpose, the reinforcement zone 2 (FIG.1) for".

Signed and Sealed this

Tenth Day of November, 1992

*Attest:*

DOUGLAS B. COMER

*Attesting Officer*

*Acting Commissioner of Patents and Trademarks*